US005377932A

United States Patent [19]

Meschi

[11] Patent Number: 5,377,932

[45] Date of Patent: Jan. 3, 1995

[54] UNWINDING DEVICE FOR PAPER REELS

[75] Inventor: Luciano Meschi, Castiglioncello, Italy

[73] Assignee: Industria Grafica Meschi SRL, Livorno, Italy

[21] Appl. No.: 90,018

[22] PCT Filed: Nov. 17, 1992

[86] PCT No.: PCT/EP92/02639

§ 371 Date: Sep. 14, 1993

§ 102(e) Date: Sep. 14, 1993

[87] PCT Pub. No.: WO91/10031

PCT Pub. Date: May 27, 1993

[30] Foreign Application Priority Data

Nov. 18, 1991 [IT] Italy ..... M1910001009[U]
Nov. 18, 1991 [IT] Italy ..... M1910001010[U]

[51] Int. Cl.[6] ..... B65H 16/02; B65H 16/10; B65H 19/10

[52] U.S. Cl. ..... 242/559; 242/563.2; 242/564.5

[58] Field of Search ..... 242/68.7, 78.7, 55, 242/57, 559, 563.2, 564.5

[56] References Cited

U.S. PATENT DOCUMENTS 3,345,010 10/1967 Egan ..... 242/66
3,406,925 10/1968 Waterhouse ..... 242/78.7
4,757,951 7/1988 Ludszeweit ..... 242/68.7
5,209,418 5/1993 Alexander, III ..... 242/68.7

FOREIGN PATENT DOCUMENTS 0384533 8/1990 European Pat. Off. .
2248996 5/1975 France .
3117093 11/1982 Germany .
3638303 5/1987 Germany .
3627533 2/1988 Germany .
3702595 8/1988 Germany .
2195322 4/1988 United Kingdom .

*Primary Examiner*—John M. Jillions
*Attorney, Agent, or Firm*—McAulay Fisher Nissen Goldberg & Kiel

[57] ABSTRACT

A device for unwinding and discharging paper reels, having endless conveyor belts rotatably mounted on a pair of oppositely disposed rollers for unwinding a paper reel and having a concave portion between the oppositely disposed rollers for receiving the paper reel, the paper reel being supported above the endless conveyor belts for frictional engagement of the reel with the endless conveyor belts for movement of an end of the paper from the reel in a direction of movement of the endless conveyor belts, and a stopping member positioned on the endless conveyor belts between the oppositely disposed rollers downstream of the paper reel, the stopping member being positioned on the endless conveyor belts prior to a substitution of another paper reel for the paper reel already on the endless conveyor belts, and the stopping member comprises a wedge-shaped member having an upper inclined surface substantially in conformity with the outer surface of the paper reel and a lower surface in conformity with an upper surface of the endless conveyor belts.

18 Claims, 5 Drawing Sheets

UNWINDING DEVICE FOR PAPER REELS

The present invention relates to improved unwinding devices for paper reels. More particularly, the invention is concerned with improved unwinding devices used for the paper reels feeding the fast printing machines, for instance laser printers, used for data processing centers such as the electronic accounting centers of banks and like institutions.

The subject reels are of very remarkable weight, of the order of hundreds of kilograms, whereby their unwinding and their handling raise problems which are not negligible. For example in the case of the feeding of laser printers the unwinding must necessarily take place at a constant, predetermined and adjustable speed, care being taken of the fact that the unwinding device is effectively served according to the printer requirements.

In the European Patent Application EP-A-384,533 in the name of the same Applicant an unwinding device is described which permits the unwinding of the continuous paper band from a reel to take place without it being necessary to support the reel onto a motorized mandrel and without the need of complex devices for the control of the reel diameter and of a consequent calibrated variation of the rotation speed of the unwinding mandrel, so as to ensure that the unwinding speed is constant.

Such a result is achieved by an unwinding device essentially comprising a number of parallel and endless belts, which are motor driven thus effecting a translation motion so that their upper or operating reach forms a loop into which the reel to be unwound abuts and seated.

The material forming the belts has a sufficient friction coefficient towards the paper, whereby the combined action of the reel weight and of the translation motion of the belts causes the paper band to be unwound from the reel as well as coming out tangentially from the reel and parallelly to the translation direction of the belts.

However, among the operating possibilities, also that requiring the substitution of the reel before it is exhausted exists, for example when it is necessary to change the size or the colour of the paper band, or because the paper band has defects such as to hinder the printing by the fast printer.

Lacking other means, the substitution must be carried out manually, whereby the attendants must stop the unwinding device and thus the translation motion of the belts, cut the paper band and cause the reel to roll out of the aforesaid loop, possibly with the help of temporary reel lifting means.

It is evident that such a proceeding has drawbacks not only from the point of view of the not negligible efforts for the carrying out of the substitution owing to the reel weight, but also and mainly from that of the dead times: if account is taken of the fact that the operating speed of a laser printer is of the order of 80 cm./sec., it is self-evident that a delay time of some minutes at least required for a reel substitution is untolerable from the point of view of the production rate of the whole processing and printing line.

In the copending Italian Patent Application No. MI91A002141, filed on Jul. 31, 1991, in the name of the same Applicant, a method and a device are disclosed for carrying out of the above mentioned operation, by which the above-mentioned problem is and is limited to the case in which the reel to be substituted has larger or a rather high diameter and thus the reel weight is essentially close to that of the starting reel, whereas problems still exist in the case that the reels to be substituted are already mostly unwound and are thus of reduced weight. As a matter of fact, since according to the solution foreseen in this patent Application the discharge of the reel to be substituted takes place by means of a possibly prismatic roller which is pushed by the translation motion of the belts against the reel and in turn pushes the reel until it comes out of the loop formed by the unwinding belts, it may happen that the reel to be substituted steps over the pushing roller falling back into the loop formed by the unwinding belts.

Another problem of the prior devices is that the weight of the reel close to the exhaustion becomes insufficient to ensure that the unwinding operation takes place correctly, whereby it must be substituted for by a new full reel. As a matter of fact the unwinding depends on the weight of the reel and thus on the force applied by the reel onto the belts.

By the way the substitution of the reel must take place before the weight insufficiency of the reel does interfere with the correct operation of the unwinding device and thus with the feeding to the printer under predetermined speed parameters.

The purpose of the present invention is that of essentially doing away with the problems and drawbacks as above shortly mentioned and particularly:

(a) provide simple and reliable means for the ready and effortless substitution of a reel being unwound in an unwinding device of the type described in the above mentioned European Application, and (b) provide means likewise simple and operatively reliable to control the stopping of the unwinding device when the height or the diameter of the reel being unwound diminishes below a predetermined value.

The device according to the present invention is of the type useful in a method and device in which, after the translation direction of the unwinding belts has been inverted, a stopping member is positioned downstream of the reel so that the translation motion of the belts, in response to friction acting on the reel, progressively pushes the latter out of the loop formed by said belts, the reel being prevented from falling back into said loop due to the said stopping member, is characterized in that said stopping member consists of a wedge-like member having an upper inclined surface provided to come into contact with the outer surface of the reel, whereas the lower surface of the wedge-like member is placed into contact for the friction dragging with the upper surface of at least one unwinding belt.

Without imposing undue limitations to the present invention, it is worth to note that the combination of the dragging by friction of the wedge-like member with the tendency of the reel to fall back when it starts the displacement from said loop and the climbing of the even short inclined flank of the exit side of said loop causes the wedge-like member to become and more wedged in between the reel and belts, whereby the weight of the reel cooperates in ensuring the engagement between the reel and the wedge-like member, thus being in opposition to the possible jumping of the reel with the related falling back into the aforesaid loop. According to another feature of the present invention the device of the invention is characterized in that at the exit end of the unwinding device means are provided for sensing the height of the reel being unwound, said sensing means having connected thereto means for stopping the operation of the unwinding device in order to permit a new paper reel to be charged within the loop formed by the unwinding belts when the height or diameter of the reel diminishes below a predetermined value.

The specific features and advantages of the present invention shall more clearly appear from the following detailed description of the preferred embodiments with reference to the accompanying drawings, in which.

Figures 1, 4:
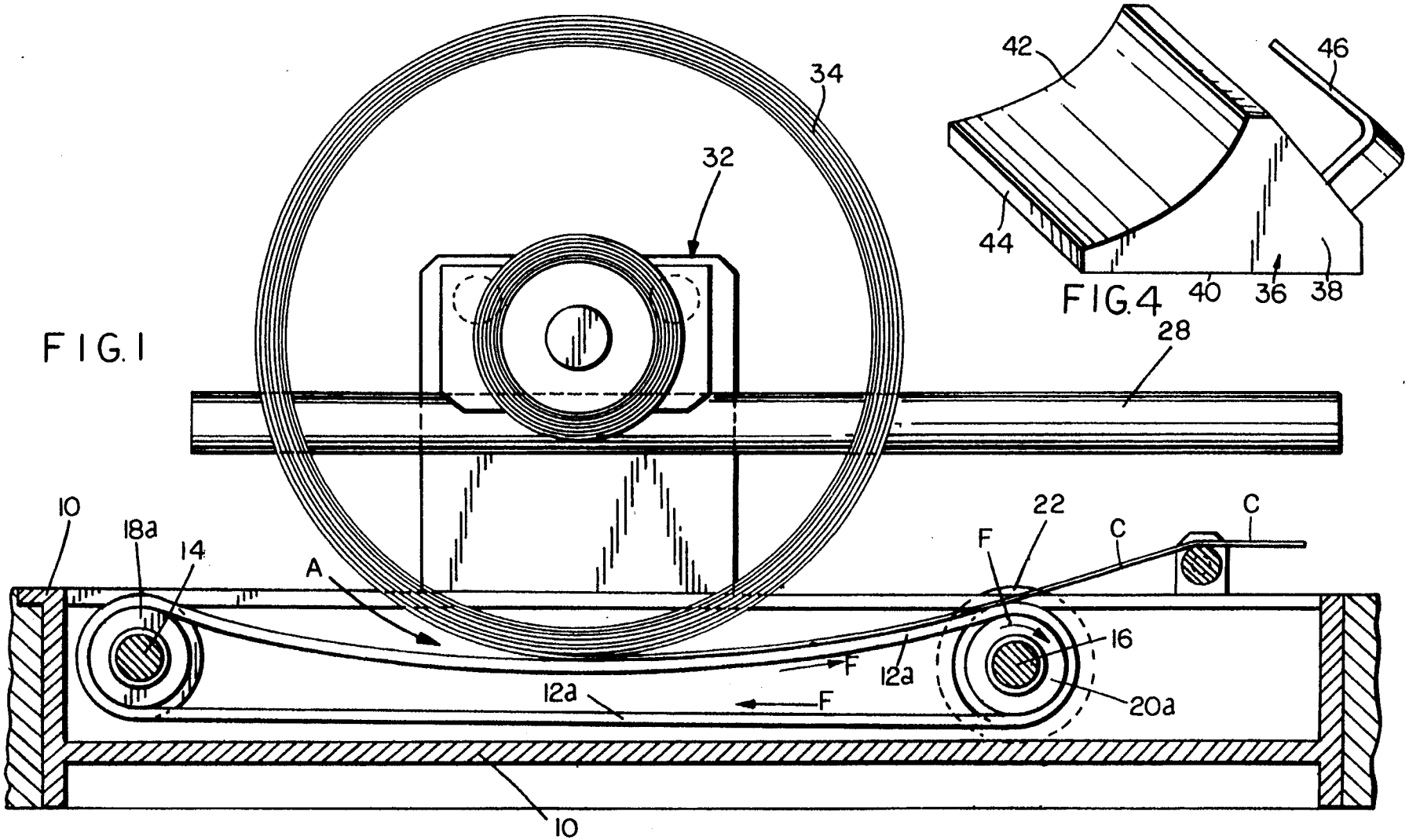
FIG. 1 is a side elevation, partially cross sectioned, view of the unwinding device of the invention in the normal operating condition.
FIG. 4 is a perspective view of the wedge-like member used according to the present invention.
Figure 3:
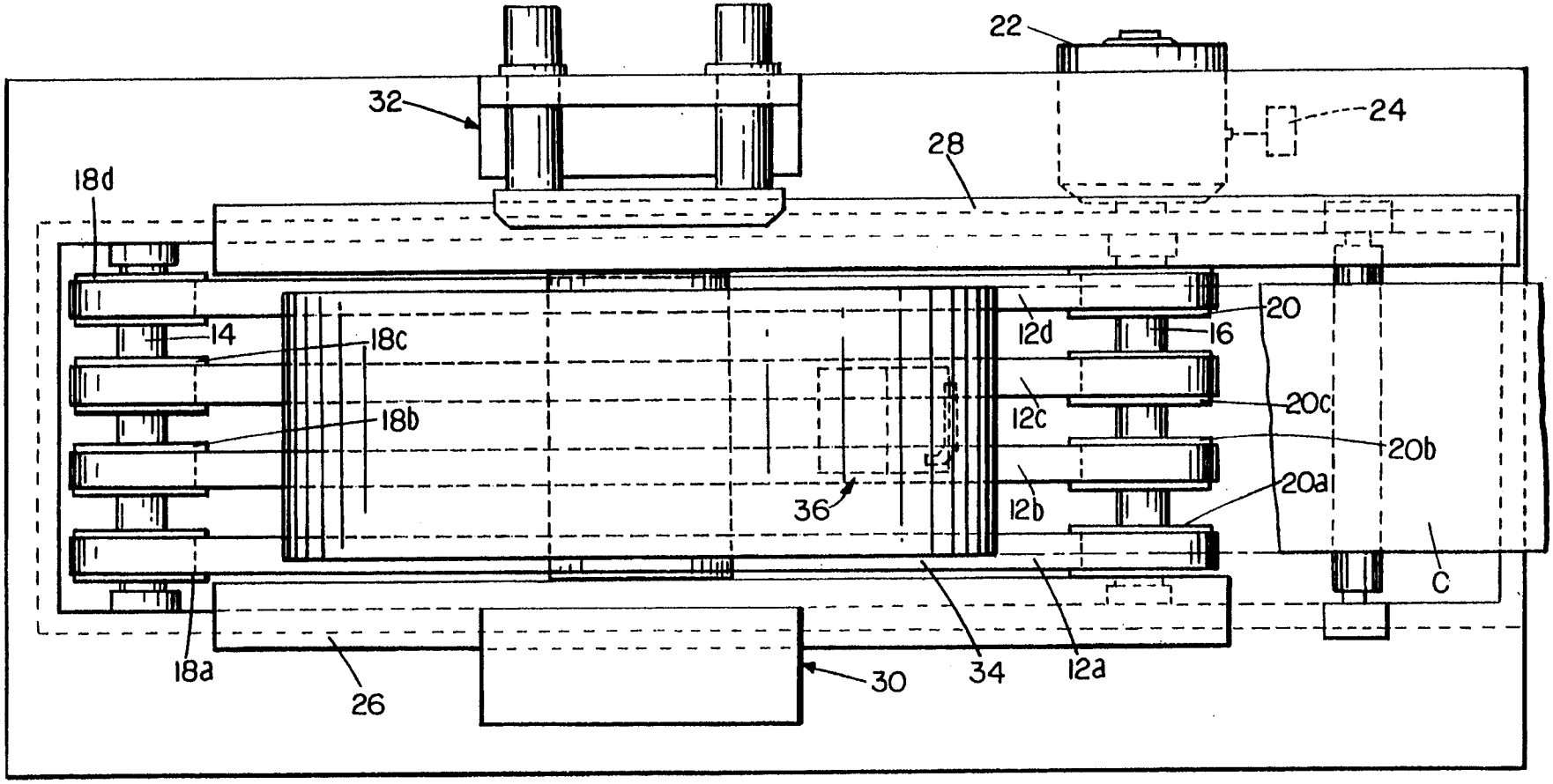
FIG. 3 is a plan view as viewed from above of FIG. 2.

Referring firstly to FIG. 1 there is shown the unwinding device comprising a frame 10 within which a number of belts is positioned, indicated by the references 12 (*a,b,c* and *d*), of the endless type and mounted onto two end shafts or rollers 14 and 16, having secured thereto, for example by keying, sleeves 18 (*a,b,c* and *d*) and 20 (*a,b,c,* and *d*), see FIG. 3, the above identified belts being engaged therewith.

The sleeves 18 and 20 are preferably toothed and the belts 12 are correspondingly toothed in order to avoid any slipping between the belt and sleeve from occurring. Either roller, in FIG. 2 the roller 20, is driven into rotation by a motor 22, possibly by interposing a variometer or a gearmotor, whereas the roller 18 is idly mounted and serves as a mere return roller. The reference 24 indicates a control member of traditional type for the operation of the motor 22.

The side bars 26 and 28, mounted onto supports generically indicated by the references 30 and 32, serve to maintain the reel 34 in alignment with the translation direction of the belts 12 indicated by the arrow F; of course at least one of the supports 30 and 32 is crosswise adjustable so as to permit the adjustment according to the width of the reel and thus of the paper band from which it is formed.

The upper reach of the belts 12 forms a loop indicated by the reference A and by the arrow in FIG. 1, in which the reel 34 is placed; the paper band C is unwound from the reel 34 and advanced in the direction of the arrow F by the friction effect between the upper surface of the belts 12 and the outer surface of the reel 34. The advancement speed of the paper band C depends on the translation speed of the belts 12 and thus on the speed at which the roller 16 is driven by the motor 22. It is worth to note that the motor 22 is of reversible type namely rotatable in both directions and it can be controlled by per se known control means so as to adjust the rpm thereof as a function for example of the requirements of the downstream positioned laser printer.

When it is desired to substitute the reel 34 with another one which for instance is of a different size, namely having a different band width from which it is formed, the motor 22 is stopped and the paper band is torn off downstream of the unwinding device. Then the wedge-like member 36, more specifically shown in FIG. 4 and described hereinafter, is positioned between the upper surface of the belts 12 and the outer surface of the reel 34.

Figure 2:
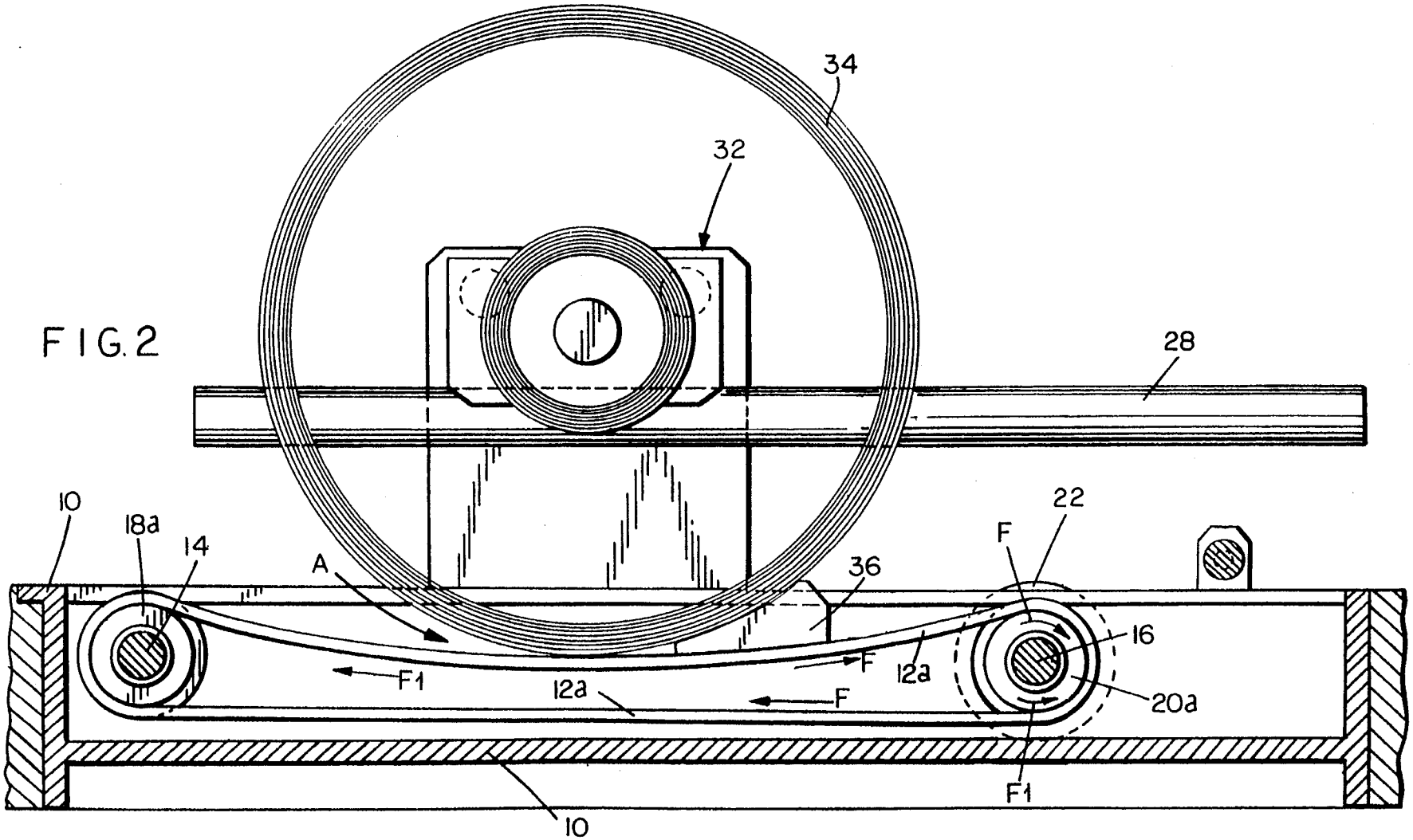
FIG. 2 is a view like FIG. 1 in the condition of discharge of the reel being unwound.

Thereupon the motor 22 is operated again in the opposite direction, namely in the direction as indicated by the arrow $F_1$, whereby the wedge-like member is progressively wedged in between the belts 12 and the outer surface of the reel 34, and the latter is progressively pushed towards the upstream end namely the left side of the drawing as viewed in FIG. 2, so that the reel 34 steps over the short inclined side defining the loop A and then is able to come out of the frame 10, thus making the unwinding device available to receive a new desired reel.

At that time it is enough to remove the wedge-like member 36 and operate again the motor 22 in the direction of the arrow F of FIG. 1, after having inserted the free end of the paper band of the new reel at the inlet of the downstream positioned laser printer.

Referring now to FIG. 4, the wedge-like member 36 consists of a block 38 having a base 40, either planar or suitably curved (the curvature being not shown in the figure) so as to match the slight curvature of the belts 12 in the area of the loop A. The operating part of the block 38 has a concave portion 42 which is joined to the base 40 so as to define a wedge-like member, the edge 44 of which shall have its height as much as possible reduced, consistently with the requirements of mechanical strength and particularly with the requirement of preventing any warping each time it is used, due to the relevant weight of the reels 34. At the rear part the block 38 has a suitably inclined surface to permit a handle 46 to be provided.

The wedge-like member has been described with reference to a preferred embodiment thereof, it being meant that mechanically and functionally equivalent modifications are possible and foreseable without coming out of the scope of the present invention. More particularly it seems necessary that the wedge-like member maintains the shape defined by the surfaces 40 and 42, whereas no particular requisites exist as regards the remaining parts of the member 36.

Figure 5:
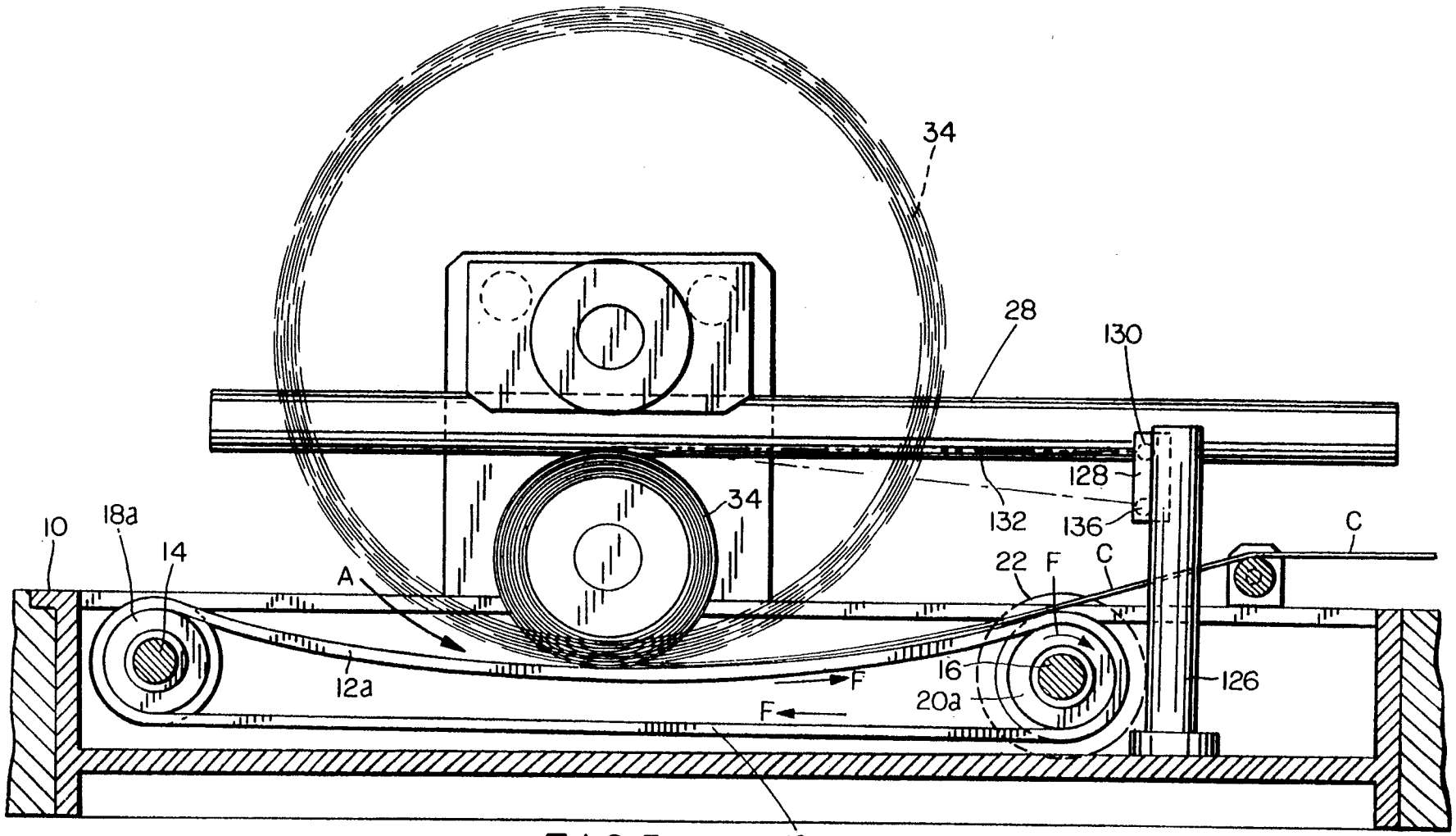
FIGS. 5 and 6 are views like FIG. 1 and FIG. 3 respectively, showing another feature of the device according to the present invention.
Figure 6:
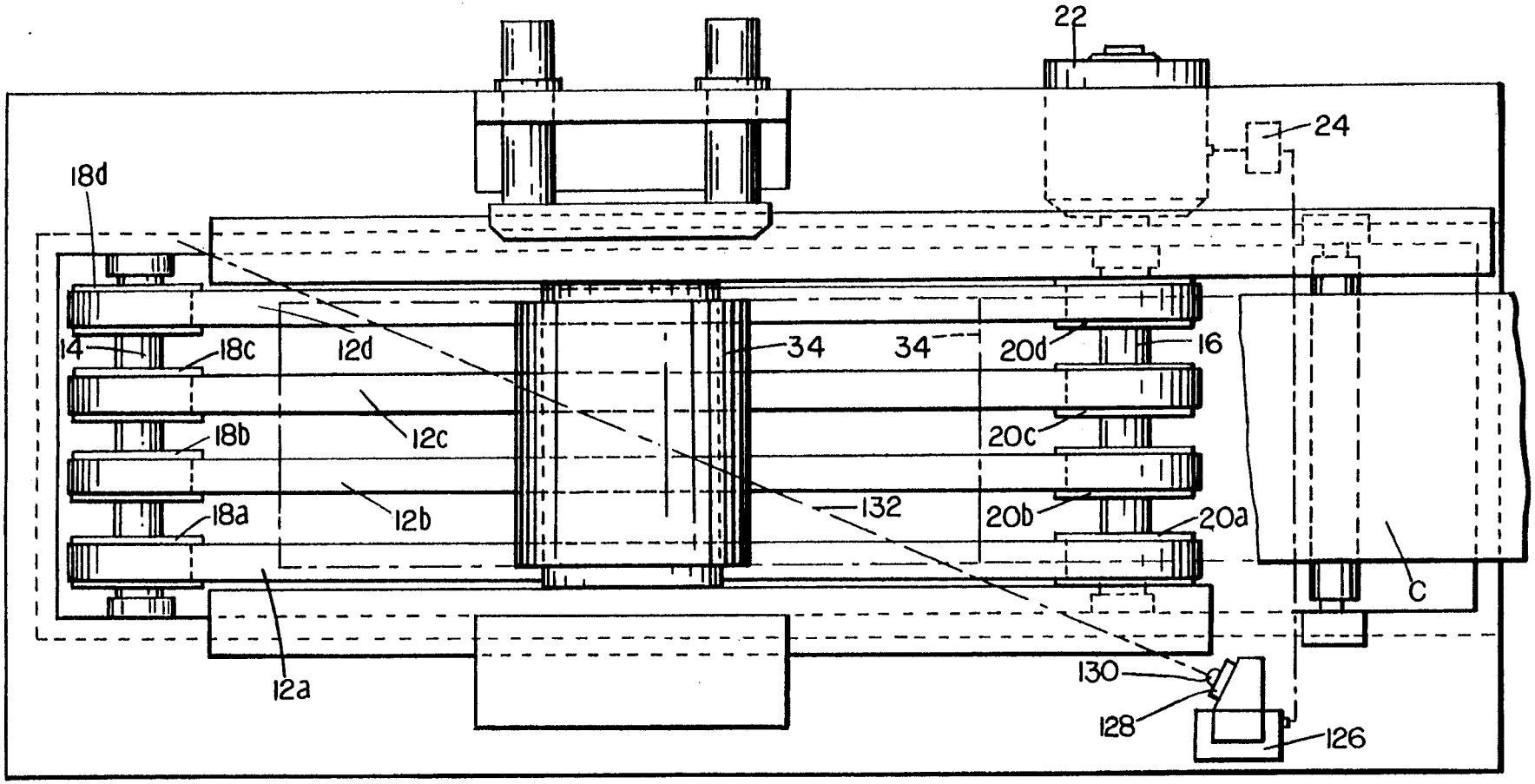

Considering now the FIGS. 5 and 6, the situation is shown of the case in which the reel 34 is close to the exhaustion thereof; at that time the weight thereof is no longer sufficient to keep it in the illustrated position and the unwinding of the paper band C therefrom is no longer permitted.

According to the present invention, see FIG. 5, downstream of the roller 16 an upright 126 is provided having at the upper end thereof sensing means 128, which in this embodiment consist of a reflecting photocell which is per se known. Preferably the height of the upright 126 is selected in such a manner that the photocell 128 is capable of sending through an emitter 130 a light ray 132 in a direction suitable to be intercepted by the reel 34 and by the paper present thereonto, giving place to the forming of a reflected ray 134 which is directed to the receiver 136 of the photocell 128. When the diameter of the reel is reduced to a value such that the ray 132 is no longer intercepted and thus the reflected ray 134 is no longer generated or when the receiver 136 is no longer receiving the reflected ray for a predetermined time (so as to avoid spurious influences due to oscillations of the reel 34 when it is close to its exhaustion) a control signal is generated from the photocell 128 whereby on one side in a per se known manner the motor 22 is stopped and on the other side the signal is transmitted to the downstream positioned printer so that the latter is stopped.

As it is clearly shown in FIG. 6, the photocell 128 is oriented so that the light ray 132 is crosswise or diagonally directed with respect to the rectangle representing in plan the reel 34 so as to ensure the intercepting of the light ray 132 by the reel 34. In this case also, conceptually and mechanically equivalent modifications are possible and foreseable for the skilled artisan.

I claim:

1. A device for unwinding a paper reel and removing it from an unwinding mechanism, wherein said unwinding mechanism includes endless conveyor means rotatably mounted on a pair of spaced oppositely disposed roller means for unwinding a paper reel to be unwound, said endless conveyor means having a concave portion between said oppositely disposed roller means for receiving said paper reel to be unwound and, means supporting said paper reel above said endless conveyor means for frictional engagement of an outermost surface of said reel with said endless conveyor means for movement of an end of the paper from said reel in a direction of movement of said endless conveyor means; and said device comprises:

stopping means being positionable on said endless conveyor means between said oppositely disposed roller means downstream of said paper reel, and said stopping means being positioned on said endless conveyor means prior to a substitution of another paper reel for the paper reel already on said endless conveyor means; and said stopping means comprising a wedge-shaped member having an upper inclined surface substantially in conformity with the outer surface of said paper reel and a lower surface in conformity with an upper surface of said endless conveyor means.

2. The device according to claim 1, wherein said upper inclined surface is a concave surface having a curvature matching the outer surface of said paper reel and said lower surface has a slight curvature with the convexity outwardly directed.

3. The device according to claim 1, wherein said lower surface has a slight curvature with an outwardly directed convexity.

4. The device according to claim 1, wherein said upper surface is a concave surface in conformity with said paper reel.

5. The device according to claim 1, wherein said device has a common wedging edge and said upper surface and said lower surface converge to said common wedging edge.

6. The device according to claim 2, wherein said device has a common wedging edge and said upper surface and said lower surface converge to said common wedging edge.

7. The device according to claim 1, including sensing means at an exit end, for the paper band, from said unwinding mechanism, means for sensing the height of the paper being unwound, and means for stopping the operation of said unwinding device connected to said sensing means to permit a new paper reel to be placed within said concave portion forming a concave loop (A) when the diameter of the paper reel diminishes below a predetermined value.

8. The device according to claim 6, wherein said endless means includes conveyor belts, and said sensing means includes a reflection photocell comprising an emitter for sending an impinging light ray in a direction to intercept the paper reel and a receiver receiving a light ray reflected from the paper reel, said reflected ray being generated by said light ray impinging against the outer surface of said paper reel, and means mounting said reflection photocell at the upper end of a vertical upright, positioned at the downstream end of said conveyor belts with reference in the direction of the translation motion of the belts.

9. The device according to claim 8, wherein said vertical upright has a height for positioning said photocell at a height that the emitted light ray is intercepted by the paper reel when the latter has a diameter greater than a predetermined value.

10. The device according to claim 9, wherein said reflection photocell is positioned so that the emitted light ray is directed according to a diagonal of the rectangle representing in a plan view the paper reel.

11. The device according to claim 8, wherein said photocell is programmed so that when a predetermined time elapses without said receiver receiving said reflected ray, the photocell emits an electric signal causing the motor means driving said at least one belt to be stopped.

12. The device according to claim 11, including means directing said signal to a printer fed by the paper band unwound from said reel.

13. A device for unwinding and discharging paper reels, comprising:

endless conveyor belts rotatably mounted on a pair of spaced oppositely disposed roller means for unwinding a paper reel to be unwound, said endless conveyor belts having a concave portion between said oppositely disposed roller means for receiving said paper reel to be unwound;

means supporting said paper reel above said endless conveyor belts for frictional engagement of an outermost surface of said reel with said endless conveyor belts for movement of an end of the paper from said reel in a direction of movement of said endless conveyor belts; and stopping means positioned on said endless conveyor belts between said oppositely disposed roller means downstream of said paper reel;

said stopping means being positioned on said endless conveyor belts prior to a substitution of another paper reel for the paper reel already on said endless conveyor belts; and said stopping means comprising a wedge-shaped member having an upper inclined surface substantially in conformity with the outer surface of said paper reel and a lower surface in conformity with an upper surface of said endless conveyor means.

14. The device according to claim 13, wherein said upper inclined surface is a concave surface having a curvature matching the outer surface of the paper reel to be substituted.

15. The device according to claim 13, including sensing means for sensing the height of the paper being unwound, and means responsive to said sensing means for stopping operation of the paper reel being unwound to permit a new paper reel to be placed within said concave portion when the diameter of the paper reel being unwound diminishes below a predetermined value.

16. The device according to claim 15, wherein said sensing means includes a transmitter and a receiver, said transmitter including an emitter for sending a light ray towards said paper reel and said receiver receives a ray reflected from said paper reel after impinging against the outer surface of said paper reel.

17. The device according to claim 15, wherein said sensing means is positioned at the downstream end of said endless conveyor belts in the direction of movement of said belts.

18. The device according to claim 16, wherein said sensing means is programmed so that when a predetermined time is elapsed without said receiver receiving said reflected ray, said sensing means emits an electric signal causing a motor means driving said at least one belt to be stopped.

* * * * *